United States Patent [19]

Yarwood et al.

[11] Patent Number: 4,530,394

[45] Date of Patent: Jul. 23, 1985

[54] CONTROLLED WATER APPLICATION FOR ELECTROMAGNETIC CASTING SHAPE CONTROL

[75] Inventors: John C. Yarwood, Madison; Derek E. Tyler, Cheshire, both of Conn.

[73] Assignee: Olin Corporation, New Haven, Conn.

[21] Appl. No.: 547,530

[22] Filed: Oct. 31, 1983

Related U.S. Application Data

[63] Continuation of Ser. No. 293,428, Aug. 17, 1981, abandoned, which is a continuation of Ser. No. 56,773, Jul. 11, 1979, abandoned.

[51] Int. Cl.[3] ..... B22D 27/02

[52] U.S. Cl. ..... 164/467; 164/503; 164/486; 164/487; 164/444

[58] Field of Search ..... 164/467, 503, 486, 487, 164/444

[56] References Cited

U.S. PATENT DOCUMENTS

| | | | |
|---|---|---|---|
| 2,851,750 | 9/1958 | Schaaber . | |
| 3,467,166 | 9/1969 | Getselev et al. . | |
| 3,502,133 | 3/1970 | Carson . | |
| 3,605,865 | 9/1971 | Getselev . | |
| 3,985,179 | 10/1976 | Goodrich et al. . | |
| 4,004,631 | 1/1977 | Goodrich et al. . | |
| 4,156,451 | 5/1979 | Getselev . | |
| 4,158,379 | 6/1979 | Yarwood et al. | 164/467 |
| 4,161,206 | 7/1979 | Yarwood et al. . | |
| 4,215,736 | 8/1980 | Gaule et al. . | |
| 4,236,570 | 12/1980 | Gaule et al. | 164/467 |

FOREIGN PATENT DOCUMENTS

| | | | |
|---|---|---|---|
| 460318 | 5/1973 | Australia . | |
| 913323 | 10/1972 | Canada | 164/467 |
| 930925 | 7/1973 | Canada . | |
| 15870 | 6/1982 | European Pat. Off. . | |
| 2803503 | 8/1978 | Fed. Rep. of Germany . | |
| 2914246 | 7/1980 | Fed. Rep. of Germany . | |
| 2429633 | 1/1980 | France . | |
| 667577 | 3/1952 | United Kingdom . | |
| 2009002 | 6/1979 | United Kingdom . | |
| 338037 | 5/1977 | U.S.S.R. . | |

*Primary Examiner*—Kuang Y. Lin

*Attorney, Agent, or Firm*—Howard M. Cohn; Barry L. Kelmachter; Paul Weinstein

[57] ABSTRACT

A method and apparatus is disclosed for electromagnetic casting of metal and alloy ingots of rectangular or other desired shape having corners or portions of small radius of curvature. A coolant application system is provided which lessens the severity of the rounding off or radius of the corners of the electromagnetically cast ingots by contouring the coolant application rate and/or elevation so that the rate and/or elevation is a minimum at the corners of the ingot.

17 Claims, 5 Drawing Figures

CONTROLLED WATER APPLICATION FOR ELECTROMAGNETIC CASTING SHAPE CONTROL

This application is a continuation of U.S. application Ser. No. 293,428, filed Aug. 17, 1981, by John C. Yarwood et al., for CONTROLLED WATER APPLICATION FOR ELECTROMAGNETIC CASTING SHAPE CONTROL, which in turn is a continuation of U.S. application Ser. No. 56,773, filed July 11, 1979, by John C. Yarwood et al., for CONTROLLED WATER APPLICATION FOR ELECTROMAGNETIC CASTING SHAPE CONTROL, both now abandoned.

CROSS REFERENCE TO RELATED APPLICATIONS

This application is related to the following U.S. applications: U.S. application Ser. No. 921,298 (now U.S. Pat. No. 4,158,379), filed July 3, 1978 and U.S. application Ser. No. 957,420 (now U.S. Pat. No. 4,388,962), filed on Nov. 2, 1978, both entitled ELECTROMAGNETIC CASTING METHOD AND APPARATUS; U.S. application Ser. No. 1,730 (now U.S. Pat. No. 4,236,570), filed on Jan. 8, 1979 entitled INGOT SHAPE CONTROL BY DYNAMIC HEAD IN ELECTROMAGNETIC CASTING; U.S. application Ser. No. 25,493 (now U.S. Pat. No. 4,215,738), filed Mar. 30, 1979 entitled ANTI-PARALLEL INDUCTORS FOR SHAPE CONTROL IN ELECTROMAGNETIC CASTING; and copending U.S. application Ser. No. 56,463 (now abandoned), filed July 11, 1979, entitled ELECTROMAGNETIC CASTING SHAPE CONTROL BY DIFFERENTIAL SCREENING, all assigned to the assignee of the instant invention.

BACKGROUND OF THE INVENTION

This invention relates to an improved process and apparatus for control of corner shape in continuous or semicontinuous electromagnetic casting of desired shapes, such as for example, sheet or rectangular ingots of metals and alloys. The basic electromagnetic casting process has been known and used for many years for continuously or semicontinuously casting metals and alloys.

One of the problems which has been presented by electromagnetic casting of sheet or rectangular ingots has been the existence of high radius of curvature corners thereon. Rounding off of corners in electromagnetic cast sheet ingots is a result of higher electromagnetic pressure at a given distance from the inductor near the ingot corners, where two proximate faces of the inductor generate a larger field. This is in contrast to lower electromagnetic pressure at the same distance from the inductor on the broad face of the ingot remote from the corner, where only one inductor face acts.

There is a need to form small radius of curvature corners on sheet ingots so that during rolling cross-sectional changes at the edges of the ingot are minimized. Larger radius of curvature corners accentuate tensile stress at the ingot edges during rolling which causes edge cracking and loss of material. Thus, by reducing the radius of curvature of the ingot at the corners there is a maximizing in the production of useful material.

It has been found in accordance with the present invention that rounding off of corners in electromagnetic casting can be made less severe or of smaller radius by contouring the coolant application rate or elevation (or both) so that the rate and/or elevation is a minimum at the corners of the ingot.

PRIOR ART STATEMENT

Known electromagnetic casting apparatus comprises a three part mold consisting of a water cooled inductor, a non-magnetic screen and a manifold for applying cooling water to the ingot being cast. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the forming ingot shell.

In some prior art approaches the inductor is formed as part of the cooling manifold so that the cooling manifold supplies both coolant to solidify the casting and to cool the inductor. See U.S. Pat. 4,004,631 to Goodrich et al.

Non-magnetic screens of the prior art are typically utilized to properly shape the magnetic field for containing the molten metal as exemplified in U.S. Pat. No. 3,605,865 to Getselev. Another approach with respect to use of nonmagnetic screens is exemplified as well in U.S. Pat. No. 3,985,179 to Goodrich et al. Goodrich et al. '179 describes the use of a shaped inductor in conjunction with a screen to modify the electromagnetic forming field.

It is generally known that during electromagnetic casting the solidification front between the molten metal and the solidifying ingot at the ingot surface should be maintained within the zone of high magnetic field strength, ie the solidification front should be located within the inductor. If the solidification front extends above the inductor, cold folding is likely to occur. On the other hand, if it recedes to below the inductor, a bleed out or decantation of the liquid metal is likely to result. Getselev et al. '166 associate the coolant application manifold with the screen portion of the mold such that they are arranged for simultaneous movement relative to the inductor. In U.S. Pat. No. 4,156,451 to Getselev a cooling medium is supplied upon the lateral face of the ingot in several cooling tiers arranged at various levels longitudinally of the ingot. Thus, depending on the pulling velocity of the ingot the solidification front can be maintained within the inductor by appropriate selection of one of the tiers.

U.S. patent application Ser. Nos. 921,298 filed July 3, 1978 (now U.S. Pat. No. 4,158,379) and 957,420 filed Nov. 2, 1978, describe adjustable and variable coolant application systems which control the position of the solidification front at the surface of the casting without modifying the magnetic field.

Other approaches to improved ingot shape have included provision of more uniform fields at conductor bus connections (Canadian Patent 930,925 to Getselev), and use of antiparallel inductors between the main inductor and the faces of sheet ingots to control surface perturbations (U.S. application Ser. No. 25,493 filed Mar. 30, 1979 now U.S. Pat. No. 4,215,738).

U.S. application Ser. No. 1,730 filed Jan. 8, 1979 (now U.S. Pat. No. 4,236,570) recognized that in electromagnetically casting rectangular or sheet ingots that the ingots are often cast with high radius of curvature ends or corners which is indicative of the need for improved ingot shape control at the corners of such ingots. The application discloses the use of a baffled hot top and/or a nozzle for providing increased directionality and increased dynamic head toward the ingot corners Finally, U.S. Pat. No. 3,502,133 to Carson teaches utilizing a sensor in a continuous or semi-continuous casting mold to sense temperature variations at a particular location in the mold during casting. The sensor controls application of coolant to the mold and forming ingot. Use of such a device overcomes instabilities with respect to how much extra coolant is required at start up of the casting operation and just when or at what rate this excess cooling should be reduced. The ultimate purpose of adjusting the flow of coolant is to maintain the freeze line of the casting at a substantially constant location.

Carson '133 teaches that ingots having a width to thickness ratio on the order of 3 to 1 or more possess an uneven cooling rate during casting when coolant is applied peripherally of the mold in a uniform manner. To overcome this problem, Carson '133 applies coolant to the wide faces of the ingot and/or the mold walls and not at all (or at least at a reduced rate) to the relatively narrow end faces of the ingot and/or the mold walls.

All patents and applications described herein are intended to be incorporated by reference herein.

SUMMARY OF THE INVENTION

The present invention comprises a process and apparatus for electromagnetic casting of metals and alloys into rectangular or sheet ingots and other desired elements of shape control having small radius of curvature corners or portions by application of controlled static head (through metal head or pressure modification). In particular, a method and apparatus utilizing controlled differential static head by control of cooling water application to obtain refinement of ingot shape, particularly at the corners of rectangular ingots or other desired elements of shape in claimed.

According to the present invention control of ingot shape may be effected by selection of the rate or location of cooling water application to the forming ingot shell within or below the containment inductor. Rounding off of corners in electromagnetic casting can be made less severe or of smaller radius by contouring the water application rate or elevation (or both) so that the rate or elevation is a minimum at the corners of the ingot. Reduction of the water application rate or lowering the application level serves to reduce the local heat extraction rate along an ingot transverse cross section line of constant height. This in turn lowers the position of the solidification front at the ingot corner and correspondingly raises the metal static head or pressure at the corner. This increased pressure results in the liquid metal approaching the inductor more closely at the corner and thus filling the corner to form a smaller radius of curvature at the corner before the increased static pressure is counterbalanced by an increased electromagnetic force.

In accordance with one embodiment of this invention a water manifold or cooling water application device is provided with drilled holes or slots of a size and/or local hole density which is modified to yield locally reduced rates of water application at the ingot or desired shape corners.

In accordance with another preferred embodiment of this invention a water manifold or cooling water application device is provided wherein the elevation of the supply holes is modified so as to apply water at the lowest elevation at the ingot or desired shape corners.

In accordance with yet another preferred embodiment of this invention the holes or slots in a water manifold or cooling water application device are modified such that the angle of the holes or slots around the corners of the ingot cause the water to impinge on the ingot surface at a lower elevation at the ingot corners.

It is of course understood that hybrids of local hole cross section, hole angle, and hole elevation can also be utilized in accordance with the concepts of this invention.

In accordancece with another preferred embodiment of this invention a water manifold or cooling water application device is provided which produces a water application rate of zero over short distances at the corners of the ingot or desired shape to further accentuate the effects of reduced local cooling.

Accordingly, it is an object of this invention to provide an improved process and apparatus for electromagnetic casting of metals and alloys into sheet ingots, or other desired elements of shape control, characterized by small radius of curvature corners or portions thereon.

This and other objects will become more apparent from the following description and drawings.

DETAILED DESCRIPTION OF PREFERRED EMBODIMENTS

In all drawing Figures alike parts are designated by alike numerals.

Figure 1:
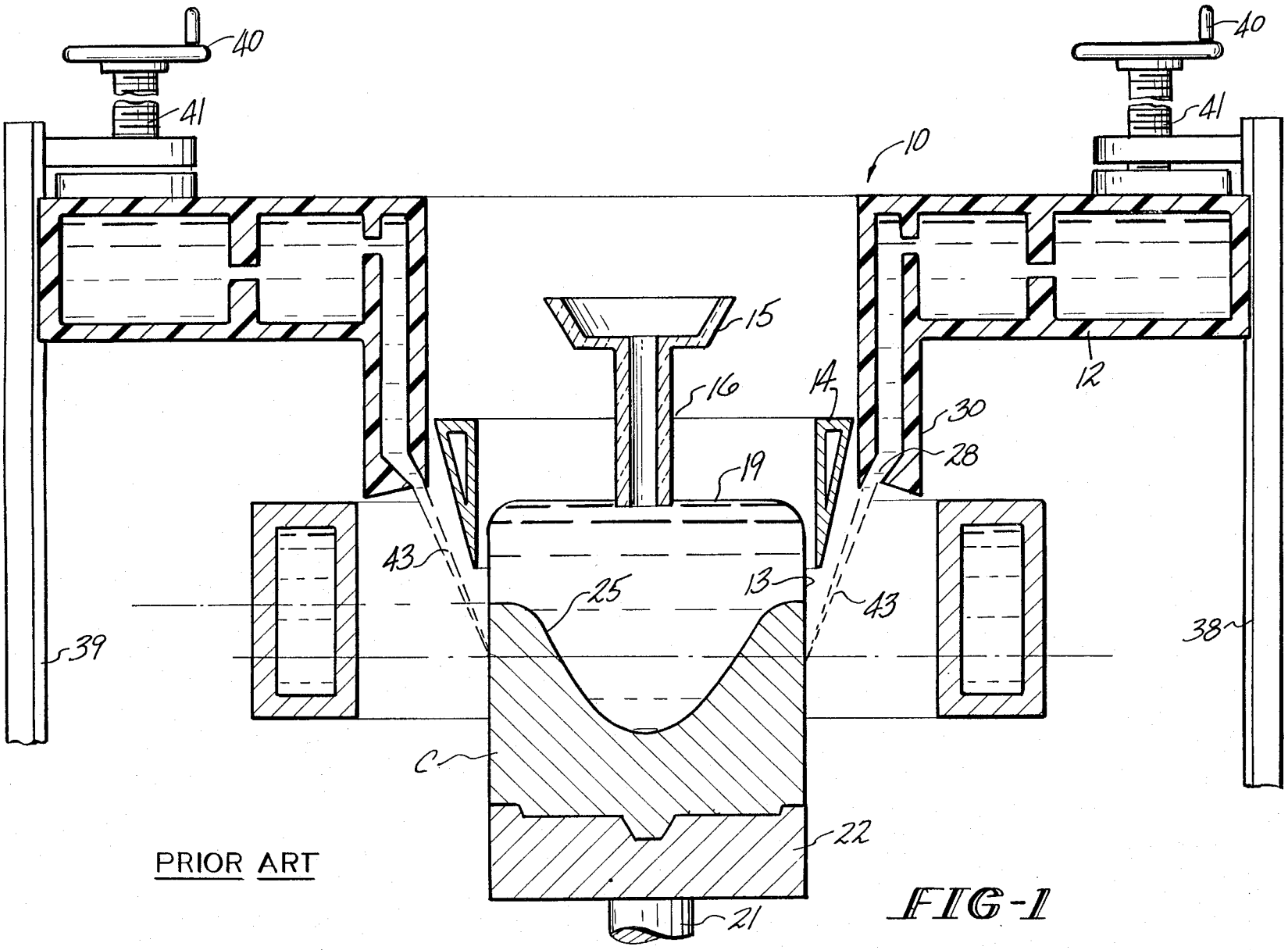
FIG-1 PRIOR ART
FIG. 1 is a schematic cross-sectional representation of a prior art electromagnetic casting apparatus utilizing a slot type coolant manifold for discharging water onto the faces of a forming ingot.

Referring now to FIG. 1 there is shown therein a prior art electromagnetic casting apparatus in accordance with U.S. Pat. No. 4,158,379.

The electromagnetic casting mold 10 is comprised of an inductor 11 which is water cooled; a coolant manifold 12 for applying cooling water to the peripheral surface 13 of the metal being cast C; and a non-magnetic screen 14. Molten metal is continuously introduced into the mold 10 during a casting run, in the normal manner using a trough 15 and down spout 16 and conventional molten metal head control. The inductor 11 is excited by an alternating current from a suitable power source (not shown).

The alternating current in the inductor 11 produces a magnetic field which interacts with the molten metal head 19 to produce eddy currents therein. These eddy currents in turn interact with the magnetic field and produce forces which apply a magnetic pressure to outer peripheral surface of the molten metal head 19 to contain it so that it solidifies in a desired ingot cross section.

An air gap exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic screen 14 is to fine tune and balance the magnetic pressure with the hydrostatic pressure of the molten metal head 19. The non-magnetic screen 14 comprises a separate element as shown, and is not a part of the manifold 12 for applying the coolant.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the peripheral ingot surface 13. The water is shown applied to the ingot surface 13 within the confines of the inductor 11. The water may be applied, however, to the ingot surface 13 from above, within or below the inductor 11 as desired.

The solidification front 25 of the casting comprises the boundary between the molten metal head 19 and the solidified ingot C. The location of the solidification front 25 at the ingot surface 13 results from a balance of the heat input from the superheated liquid metal 19 and the resistance heating from the induced currents in the ingot surface layer, with the longitudinal heat extraction from the cooling water application.

Coolant manifold 12 is arranged above the inductor 11 and includes at least one discharge port 28 at the end of extended portion 30 for directing unbaffled flow of coolant against the surface 13 of the ingot or casting. The discharge port 28 can during operation is substantially filled with coolant and can comprise a slot or a plurality of individual orifices for directing the coolant against the surface 13 of the ingot C about the entire periphery of that surface.

Coolant manifold 12 is arranged for movement along vertically extending rails 38 and 39 axially of the ingot C such that extended portion 30 and discharge port 28 can be moved between the non-magnetic screen 14 and the inductor 11. Axial adjustment of the discharge port 28 position is provided by means of cranks 40 mounted to screws 41.

The coolant is discharged against the surface of the casting in the direction indicated by arrows 43 to define the place of coolant application.

Figure 2:
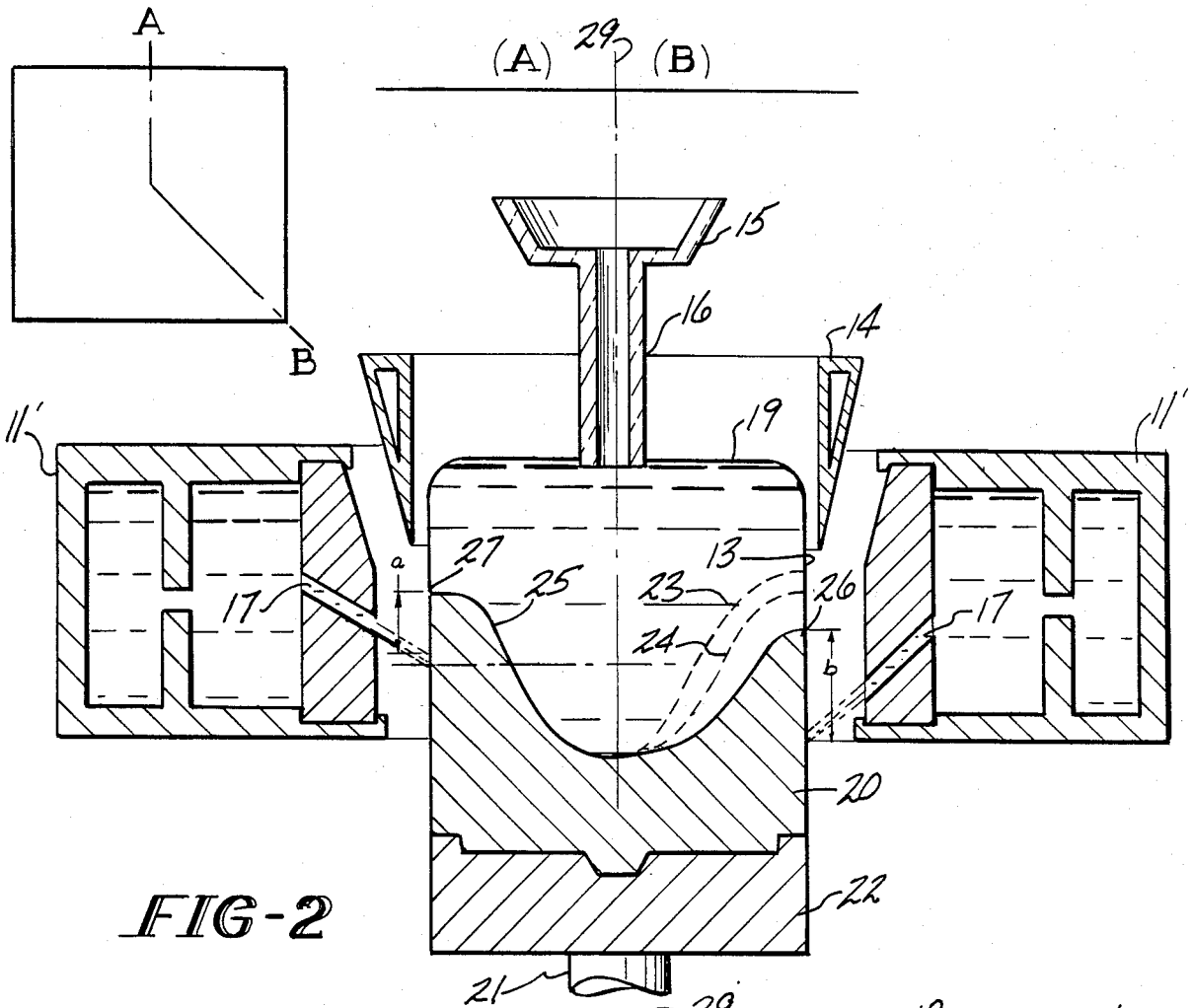
FIG. 2 is a schematic cross-sectional representation of an electromagnetic casting apparatus showing an inductor having drilled holes for supplying water to an ingot in accordance with this invention.

FIG. 2 is a schematic cross-sectional representation of one embodiment of a system for application of a coolant in accordance with this invention. Line 29, defining a longitudinal axis, divides FIG. 2 into two sides (A) and (B). Side (A) shows a section through a face of rectangular longitudinally extending ingot 20 and inductor 11' which extends transversely about the molten material and the casting while side (B) shows a section through the corner of the same elements. Coolant, typically water, is supplied to the peripheral surface 13 of ingot 20 via holes 17 in inductor 11'.

Rounding off of corners in electromagnetic casting results from higher electromagnetic pressure at a given distance from the inductor near the corner (where two proximate faces of the single turn inductor generate field) and from excess cooling or higher heat extraction rates at the corners because of geometric and higher heat transfer characteristics. Referring to FIG. 2, dotted line 23 exemplifies the location of the solidfication front at the corner of an ingot (side (B)) which is cooled by known uniform rate and height peripheral coolant flow directed to the surface 13 of rectangular ingot 20 having a plurality of transverse portions of the outer peripheral surface each with a small radius of curvature extending transversely of the longitudinal axis. As can be seen, excess cooling at the corners or transverse portions with small radius of curvature of the ingot 20 cause the solidification front to rise in comparison to the elevation of the solidification front along the faces or adjacent transverse portions of the surface of the ingot 20 (side (A)), denoted by dashed line 24. Thus, b, the height of the solidification front from the point of coolant impingement at the corners of the ingot 20 is greater than a, the height of the solidification front from the point of coolant impingement along the faces of the ingot 20. This combination of higher solidification front (lower head) and increased magnetic pressure at the corners causes the pushing of molten metal away from the corners thereby producing a highly undesirable rounding off of the ingot corners.

In accordance with this invention coolant application devices are modified to produce controlled differential static head leading to refinement of ingot shapes at the corners, and in particular to form smaller radius of curvatures at ingot corners.

Control of ingot shape is effected in accordance with the present invention by selection of the rate and/or location of cooling water impingement upon the surface of forming ingot shells. Rounding off of corners in electromagnetic casting can be made less severe or of smaller radius by contouring the water application rate and/or elevation so that the rate and/or elevation is a minimum at the corner or transverse portion with a small radius of curvature of the ingot. Reduction of the water application rate and/or lowering of the application level serves to reduce the local heat extraction rate along an ingot transverse cross section line of constant height. This in turn lowers the position of the solidification front at the ingot corners and correspondingly raises the metal static head or pressure at the corners. This increased pressure results in the liquid metal approaching the inductor more closely at the corners and thereby filling the corner to form a smaller radius of curvature before the increased static pressure is counterbalanced by the increased electromagnetic force.

As can be seen from FIG. 2, the elevation or position of the water impingement at the side (B) (the corner of ingot 20) in accordance with this invention is lower or downstream with respect to the longitudinal axis than the elevation or position at side (A) (along the face of the ingot 20) by virtue of the modification in elevation and angle of holes 17 in inductor 11'. The solidification front 25 forms as a result at a height b above the point of water impingement (point 26) but at a level lower than the point 27 where the solidification front 25 forms along the faces of ingot 20.

As an alternative to altering the angle and/or elevation of holes 17 in inductor 11' it would be possible to obtain a lowering of the solidification front at the corners of ingot 20 by reducing the diameter of holes 17 and/or by blocking one or more holes locally of the corners thereby partially reducing or reducing to zero the rate of water application at the ingot corners. Of course hybrids of hole size, density, elevation, angle and blockage could be devised to obtain the results desired with respect to cooling rate at the corners in accordance with this invention.

Figure 3:
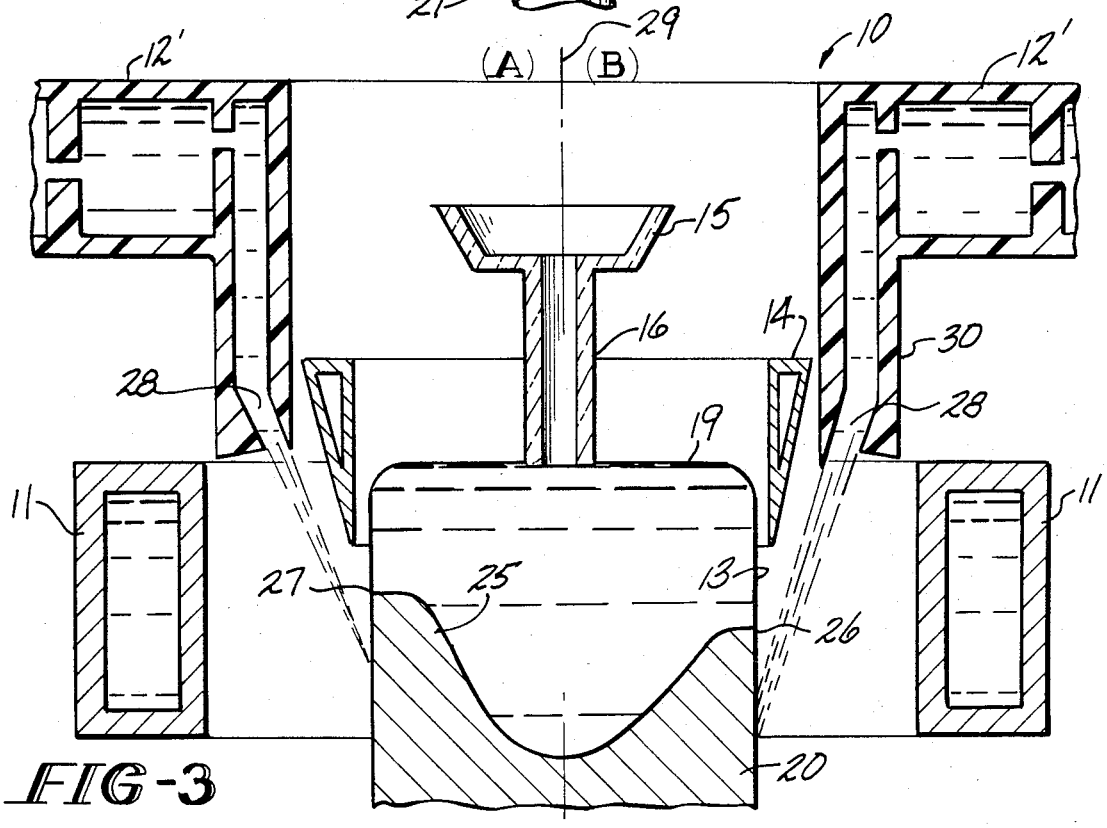
FIG. 3 is a schematic cross-sectional representation of an electromagnetic casting apparatus showing a modified slot type manifold for supplying water to an ingot in accordance with this invention.

FIG. 3 shows a partial schematic cross-sectional representation of the electromagnetic casting apparatus of FIG. 1 with a modified coolant manifold 12' in accordance with another embodiment of this invention.

FIG. 3 shows extended portion 30 to have a discharge port 28' (Side (B)) having a modified slot discharge angle causing impingement of coolant water at a lower elevation at the corners of ingot 20. Side (A) shows a standard or unmodified discharge port 28 which impinges water at a higher level along the faces of ingot 20. Solidification front 25 is seen to be at a higher level as designated by point 27 along the faces of the ingot than at or near the corners of ingot 20, designated by point 26.

Figure 4:
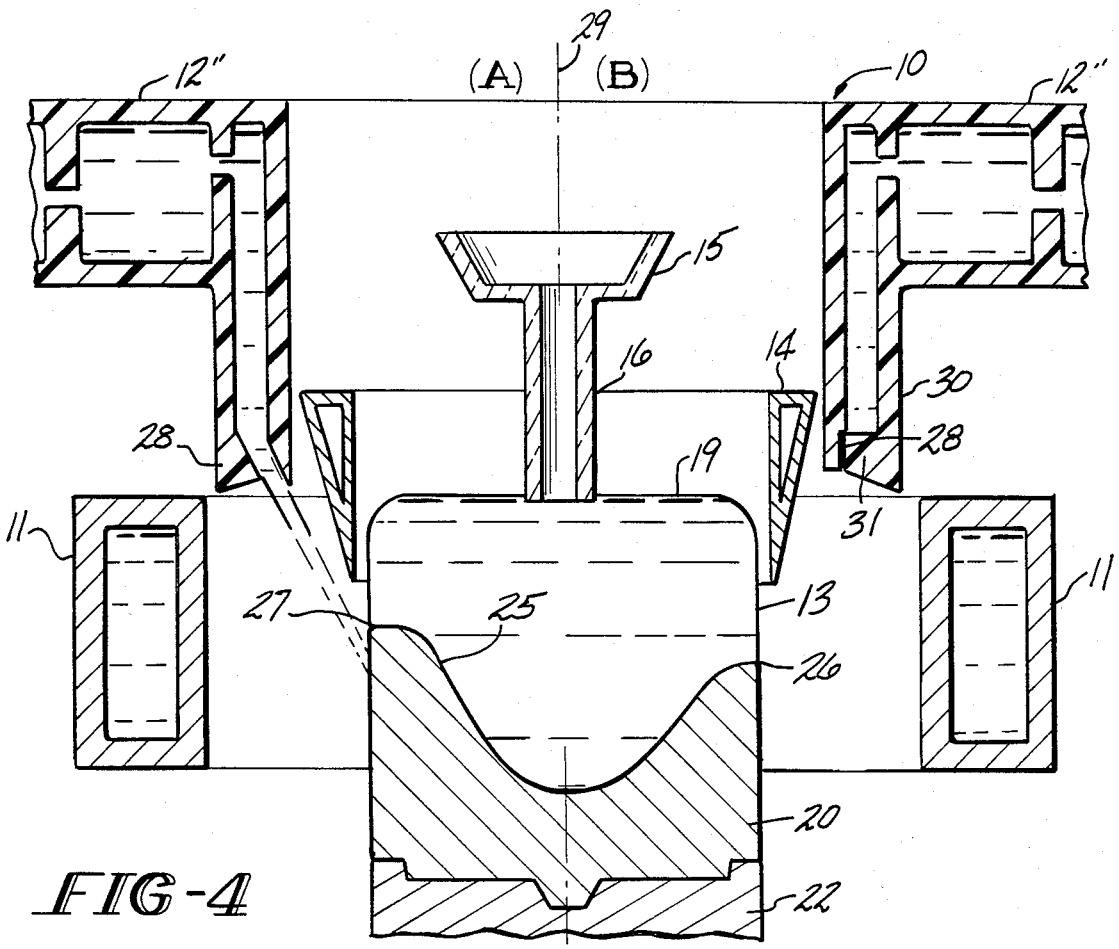
FIG. 4 is a schematic cross-sectional representation of an electromagnetic casting apparatus showing another embodiment of a modified slot type manifold for supplying coolant to an ingot in accordance with this invention.

FIG. 4 shows a partial schematic cross-sectional representation of the electromagnetic casting apparatus of FIGS. 1 and 3 with a modified coolant manifold 12" in accordance with yet another embodiment of this invention.

In FIG. 4, extended portion 30 of modified coolant manifold 12" is constructed with discharge port 28 completely blocked off at or near the corners of ingot 20 (Side (B)) by portion 31 of coolant manifold 12". Thus there is zero local cooling in the immediate corners of ingot 20 causing solidification front 25 to drop to the point 26 at the corners of ingot 20. Side (A) shows that the solidification front 25 stays at point 27 along the faces of the ingot.

Where slot type coolant manifolds such as depicted in FIGS. 1, 3 and 4 are used, the slot cross section can be accurately contoured to produce a smoothly varying water flow rate with a minimum or zero flow rate at or near the ingot corner positions.

In addition to alterring the angle of slot discharge, it is contemplated to alter the extended portion 30 at the areas of the corners of the ingot 20 to modify the elevation of the slot discharge ports so as to be lowest at the ingot corners. Thus the elevation of the impinging water can be alterred by alterring the angle and/or the actual elevation of the discharge slots. Again, hybrids of contoured slot cross section, elevation and angle could be devised to carry out the process of this invention.

Figure 5:
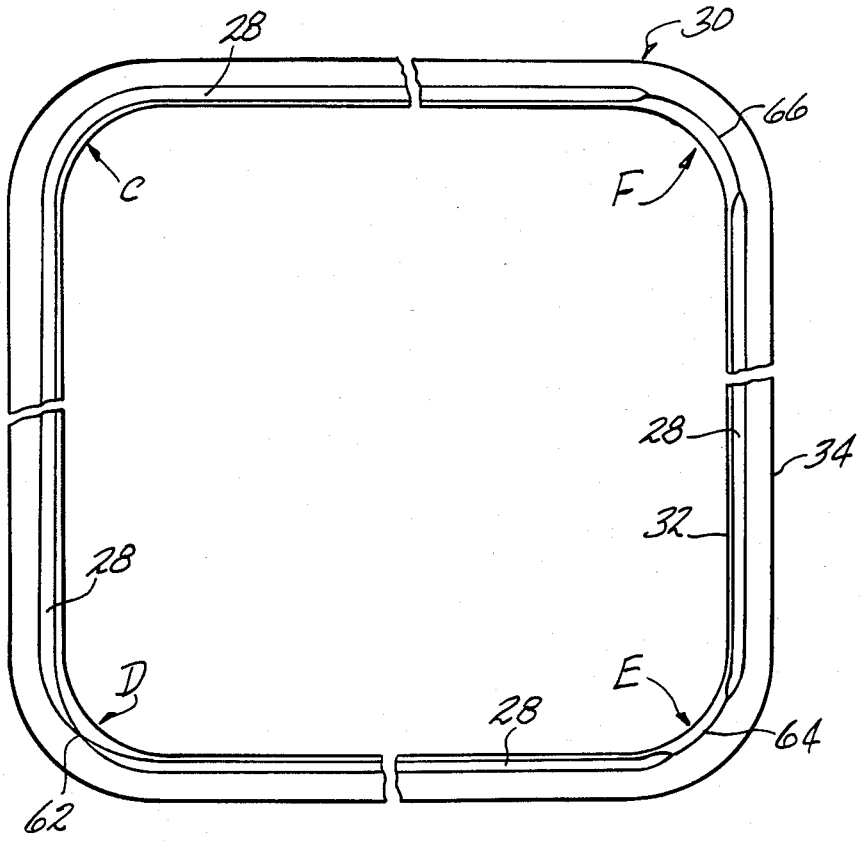
FIG. 5 is a partial bottom plan view looking up into the manifold discharge slot of a manifold showing corners possessing different slot modifications in accordance with this invention.

FIG. 5 is a bottom plan view looking up into an extended portion 30 of a manifold and shows corners possessing different slot modifications in accordance with this invention. Extended portion 30 comprises an inner wall 32. an outer wall 34 and a discharge port 28. Corner C shows an unmodified full slot discharge port 28 with a slot width equal to that along the four faces of extended portion 30. Corner D shows a contoured slot discharge port 28 with zero slot width (closed) at the exact corner 62 of extended portion 30. Corner E shows a contoured slot discharge port 28 with zero slot width over about half the corner radius 64 of extended portion 30 and corner F shows zero slot width over about virtually the whole corner radius 66 of extended portion 30.

The aforedescribed variants in coolant applying equipment are typically designed so as to modify the coolant application rate and/or impact point within about three inches on either side of a corner while the maximum extent of the modifications in coolant application is to result in substantial absence of coolant application over about one inch or less of the ingot surface about the corner.

The novel method and apparatus of the present invention find applicability in the electromagnetic casting of any shapes wherein it is desired to form portions thereon of low radius of curvature.

It is apparent that there has been provided with this invention a novel process and means for utilizing controlled differential static head by control of coolant application to obtain refinement of ingot shape during electromagnetic casting which fully satisfy the objects, means and advantages set forth herein before. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for electromagnetically forming a molten material into a longitudinally extending casting defining a longitudinal axis thereof, said casting having a desired shape with at least one transverse portion of the outer peripheral surface of said casting extending transversely of said axis having a small radius of curvature, said apparatus including means extending transversely about said molten material for providing an electromagnetic containment force field acting on the outer peripheral surface of said molten material to form said desired shape, said apparatus including cooling means extending transversely about said molten material for applying coolant to the peripheral surface of said casting, the improvement wherein:

said cooling means include discharge port means for providing an unbaffled flow of coolant directly against said casting surface, said discharge port means in operation being substantially filled with coolant;

said discharge port means further comprising means for directing said coolant directly against said casting surface at each of said at least one transverse portion of the outer peripheral surface having a small radius of curvature at a first position with respect to said longitudinal axis and for directing said coolant directly against an adjacent transverse portion of said casting peripheral surface at a second position upstream of said first position;

whereby said coolant applied to said at least one transverse portion of said peripheral casting surface having a small radius of curvature provides an increased static pressure head of molten material as compared with the static pressure head of molten material at said adjacent transverse portion of said Peripheral casting surface so that said small radius of curvature can be formed.

2. An apparatus as in claim 1 wherein said discharge port means further includes means for providing flow of coolant directly against said peripheral casting surface such that the rate of flow on said at least one transverse portion is lower as compared to the rate of flow at said adjacent transverse portion of said casting.

3. An apparatus as in claim 2 wherein said lower rate of flow on the casting surface is zero.

4. An apparatus as in claim 1 wherein said discharge port means comprises a slot being generally directed toward said peripheral surface of said casting.

5. An apparatus as in claim 4 wherein said slot is narrower at an area of said discharge port means adjacent said at least one transverse portion as compared to adjacent peripheral areas of said discharge port means.

6. An apparatus as in claim 4 wherein said slot has a smaller angle of inclination with respect to said longitudinal axis at an area of said discharge port means adjacent said at least one transverse portion as compared to adjacent peripheral areas of said discharge port means.

7. An apparatus as in claim 4 wherein said slot is at a lower elevation at an area of said discharge port means adjacent said at least one transverse portion as compared to adjacent peripheral areas of said discharge port means.

8. An apparatus as in claim 1 wherein said discharge port means comprises a plurality of orifices being generally directed toward said peripheral surface of said casting.

9. An apparatus as in claim 8 wherein there are fewer of said orifices at an area of said discharge port means adjacent said at least one transverse portion as compared to adjacent peripheral areas of said discharge port means.

10. An apparatus as in claim 8 wherein said plurality of orifices are of smaller diameter at an area of said discharge port means adjacent said at least one transverse portion as compared to adjacent peripheral areas of said discharge port means.

11. An apparatus as in claim 8 wherein said plurality of orifices have axes which are arranged at a smaller angle of inclination with respect to said longitudinal axis at an area of said discharge port means adjacent said at least one transverse portion as compared to adjacent peripheral areas of said discharge port means.

12. An apparatus as in claim 8 wherein at least one of said plurality of orifices is at a lower elevation with respect to said longitudinal axis at an area of said discharge port means adjacent said at least one transverse portion as compared to adjacent peripheral areas of said discharge port means.

13. In a process for electromagnetically forming molten material into a longitudinally extending casting defining a longitudinal axis thereof, said casting having a desired shape with at least one transverse portion of the outer peripheral surface of said casting extending transversely of said axis having a small radius of curvature, comprising the steps of:

providing an electromagnetic containment force field acting on the outer peripheral surface of said molten material to form said desired shape;

pouring said molten material into said electromagnetic force field;

providing a discharge port apparatus for applying an unbaffled flow of coolant directly against said casting surface wherein said discharge port in operation being substantially filled with said coolant; and directing said coolant directly against said casting surface at each of said at least one transverse portion of the outer peripheral surface having a small radius of curvature at a first position with respect to said longitudinal axis and directing said coolant directly against an adjacent transverse portion of said outer peripheral surface at a second position upstream of said first portion whereby said coolant applied to said at least one transverse portion of said peripheral casting surface having a small radius of curvature provides an increased static pressure head of molten material as compared with the static pressure head of molten material at said adjacent transverse portion of said peripheral casting surface so that said small radius of curvature can be formed.

14. The process as in claim 13 wherein said step of controlling the coolant flow further comprises the step of providing coolant flow upon said peripheral casting surface such that the rate of flow at said at least one transverse portion is lower as compared to the rate of flow at said adjacent transverse portion of said casting.

15. The process as in claim 14 wherein said lower rate is zero.

16. The process as in claim 13 wherein said flow of coolant is provided through a variable width slot.

17. A process as in claim 13 wherein said flow of coolant is provided through a plurality of orifices, said step of applying coolant being carried out by specifically geometrically arranging and sizing said orifices.

* * * * *